US009617966B2

(12) United States Patent
Armbrecht et al.

(10) Patent No.: US 9,617,966 B2
(45) Date of Patent: Apr. 11, 2017

(54) HIGH FREQUENCY PLASMA IGNITION DEVICE

(71) Applicant: ROSENBERGER HOCHFREQUENZTECHNIK GMBH & CO. KG, Fridolfing (DE)

(72) Inventors: Gunnar Armbrecht, Mühldorf am Inn (DE); Michael Wollitzer, Fridolfing (DE); Thomas Schmid, Teisendorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 226 days.

(21) Appl. No.: 14/399,347

(22) PCT Filed: Apr. 23, 2013

(86) PCT No.: PCT/EP2013/001210
§ 371 (c)(1),
(2) Date: Nov. 6, 2014

(87) PCT Pub. No.: WO2013/167239
PCT Pub. Date: Nov. 14, 2013

(65) Prior Publication Data

US 2015/0096517 A1 Apr. 9, 2015

(30) Foreign Application Priority Data

May 8, 2012 (DE) ..... 20 2012 004 602 U

(51) Int. Cl.
*F02P 9/00* (2006.01)
*F02P 3/01* (2006.01)
(Continued)

(52) U.S. Cl.
CPC ..... *F02P 9/007* (2013.01); *F02P 3/01* (2013.01); *F02P 23/04* (2013.01); *F02P 23/045* (2013.01); *H01T 13/50* (2013.01)

(58) Field of Classification Search
CPC ..... H01T 14/00; H01T 19/00; H01T 19/02; H01T 19/04; H01T 13/00; H01T 13/02;
(Continued)

(56) References Cited

U.S. PATENT DOCUMENTS 4,954,212 A * 9/1990 Gabriel ..... H01J 37/32935 156/345.25
4,996,967 A * 3/1991 Rosswurm ..... F02P 9/007 123/598
(Continued)

FOREIGN PATENT DOCUMENTS

DE 26 28 209 A1 1/1977
DE 10 2004 058925 A1 6/2006
DE 10 2005 036968 A1 2/2007

*Primary Examiner* — Carlos A Rivera
*Assistant Examiner* — Carl Staubach
(74) *Attorney, Agent, or Firm* — DeLio, Peterson & Curcio, LLC; Robert Curcio

(57) ABSTRACT

A high frequency plasma ignition device for the ignition of a fuel/air mixture in a combustion chamber of an internal combustion engine, having a series resonant circuit of an electric inductor and an electric capacitor connected in series, and a high frequency generator with a first electrical terminal and a second electrical terminal for the resonant excitation of the series resonant circuit, a first electrical contact point being provided in which one end of the capacitor and one end of the inductor are connected to one another electrically. An electrical connecting device connects the high-frequency generator to the inductor and to the capacitor such that an output signal of the high-frequency generator is applied to the series resonant circuit. An electric voltage is applied across the capacitor for igniting a plasma
(Continued)

between free ends of a first and second electrode. An electric voltage is further applied to maintain the plasma after ignition.

11 Claims, 3 Drawing Sheets

(51) Int. Cl.
*F02P 23/04* (2006.01)
*H01T 13/50* (2006.01)

(58) Field of Classification Search
CPC H01T 13/04; H01T 13/05; H01T 1/14; H01T 1/16; H01T 1/20; H01T 2/02; H01T 13/40–13/467; F02P 13/00
USPC ..... 123/143 R, 143 B, 169 E, 169 EL, 163, 123/594, 598, 604–608, 619, 620, 621, 123/623, 626, 636; 431/125, 127, 128; 361/247, 253, 257, 261; 315/209 CD; 313/114, 118
See application file for complete search history.

(56) References Cited

U.S. PATENT DOCUMENTS 5,140,223 A * 8/1992 Gesche ..... H03H 7/38 204/298.08
5,211,142 A * 5/1993 Matthews ..... H01T 13/50 123/143 B
5,236,636 A * 8/1993 Tisack ..... B29C 45/0053 264/102
6,321,733 B1 11/2001 Suckewer
6,662,793 B1 * 12/2003 Allen ..... H01T 13/50 123/143 R
2008/0141967 A1 * 6/2008 Tani ..... F02P 9/007 123/143 B
2010/0102728 A1 * 4/2010 Kato ..... H01T 13/50 315/111.21
2010/0194279 A1 * 8/2010 Barroso ..... F02P 9/007 315/111.21
2014/0145624 A1 * 5/2014 Ban ..... F02P 3/01 315/172

* cited by examiner

HIGH FREQUENCY PLASMA IGNITION DEVICE

BACKGROUND OF THE INVENTION

1. Field of the Invention

The present invention relates to a high-frequency plasma ignition device, in particular for an internal combustion engine and in particular for the ignition of a fuel/air mixture in a combustion chamber of an internal combustion engine.

2. Description of Related Art

Because of the possibility of producing a stratified charge in the combustion chamber, what are referred to as direct fuel injection spark-ignition processes have great potential with regard to reducing consumption. However, the non-homogeneous mixture in the combustion chamber imposes more stringent requirements for the ignition process used in respect of reliable ignition at the appropriate point in time. Fluctuations of any kind reduce for example the standard of the ignition and hence the efficiency of the entire engine. On the one hand the position of the ignitable mixture may vary slightly and on the other the hooked electrode of a spark plug may have a disruptive effect on the creation of the mixture. Something that is helpful for a direct fuel injection combustion process is an ignition system which extends further into the combustion chamber physically. To this end, it is proposed in DE 10 2004 058 925 A1 that a fuel/air mixture be ignited in a combustion chamber of an internal combustion engine by means of a plasma. A high-frequency plasma ignition device for this purpose comprises a resonant series circuit having an inductive means and a capacitive means and a high-frequency source for the resonant excitation of this resonant series circuit. The capacitive means is constituted by center and outer conductive electrodes having a dielectric situated between them. At their extreme ends, these electrodes extend into the combustion chamber at a preset distance apart.

SUMMARY OF THE INVENTION

Bearing in mind the problems and deficiencies of the prior art, it is therefore an object of the present invention to improve a high-frequency ignition device to the effect that a maximum energy input is easily achieved to ignite the plasma, and into the plasma when ignited, in spite of different impedances in the space occupied by the plasma on the one hand before the ignition of the plasma and on the other hand thereafter.

The above and other objects, which will be apparent to those skilled in the art, are achieved in the present invention which is directed to a high frequency plasma ignition device for the ignition of a fuel/air mixture in a combustion chamber of an internal combustion engine, comprising: a resonant series circuit having an inductive portion and a capacitive portion connected in series; a high-frequency generator having a first electrical terminal and a second electrical terminal for the resonant excitation of a resonant series circuit; a first electrical contact point being provided at which one end of the capacitive portion and one end of the inductive portion are connected together electrically; the capacitive portion having a second electrical contact point at an end which is remote from the first contact point and the inductive portion having a third electrical contact point at an end which is remote from the first contact point; an electrical connecting device being provided which connects the first terminal of the high-frequency generator to the third contact point electrically and the second terminal of the high-frequency generator to the second contact point electrically such that an output signal from the high-frequency generator is applied to the resonant series circuit via the second and third electrical contact points, a first electrode being connected electrically to the first electrical contact point and a second electrode being connected electrically to the second electrical contact point, such that there is available between a free end of the first electrode, which free end is remote from the first electrical contact point, and a free end of the second electrode, which free end is remote from the second electrical contact point, a voltage for igniting a plasma between the free ends of the first and second electrodes, which voltage is applied across the capacitive portion; and a third electrode electrically connected to the third electrical contact point, and a free end of the third electrode, which free end is remote from the third electrical contact point, is arranged such that a voltage for maintaining the plasma after ignition is available between the free end of the third electrode and the free end of the second electrode, which voltage is applied via the second and third electrical contact points.

The electrical connecting device may comprise an impedance matching network, such that an impedance between the first and second terminals of the high-frequency generator is matched to an impedance between the second and third electrical contact points.

The matching network may comprise an inductive portion including a coil, which connects the first terminal point of the high-frequency generator electrically to the third electrical contact point, and a capacitive portion including a capacitor, which connects the first terminal point of the high-frequency generator electrically to the second terminal point of the high-frequency generator.

The capacitive portion in the resonant series circuit may include at least one capacitor, at least one parallel-plate capacitor, at least one spherical capacitor, at least one cylindrical capacitor, at least one co-axial cable, at least one pair of conductors, at least one feed-through capacitor, or by two electrical conductors of a predetermined length at a predetermined spacing with a dielectric between them, or any combination thereof.

The inductive portion in the resonant series circuit may include at least one coil, at least one toroidal coil, at least one cylindrical coil, at least one co-axial conductor, at least one coil having a magnetic core, at least one transformer, or at least one electrical conductor, or any combination thereof.

The high-frequency plasma ignition device may include a housing which forms at least part of the second electrode.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
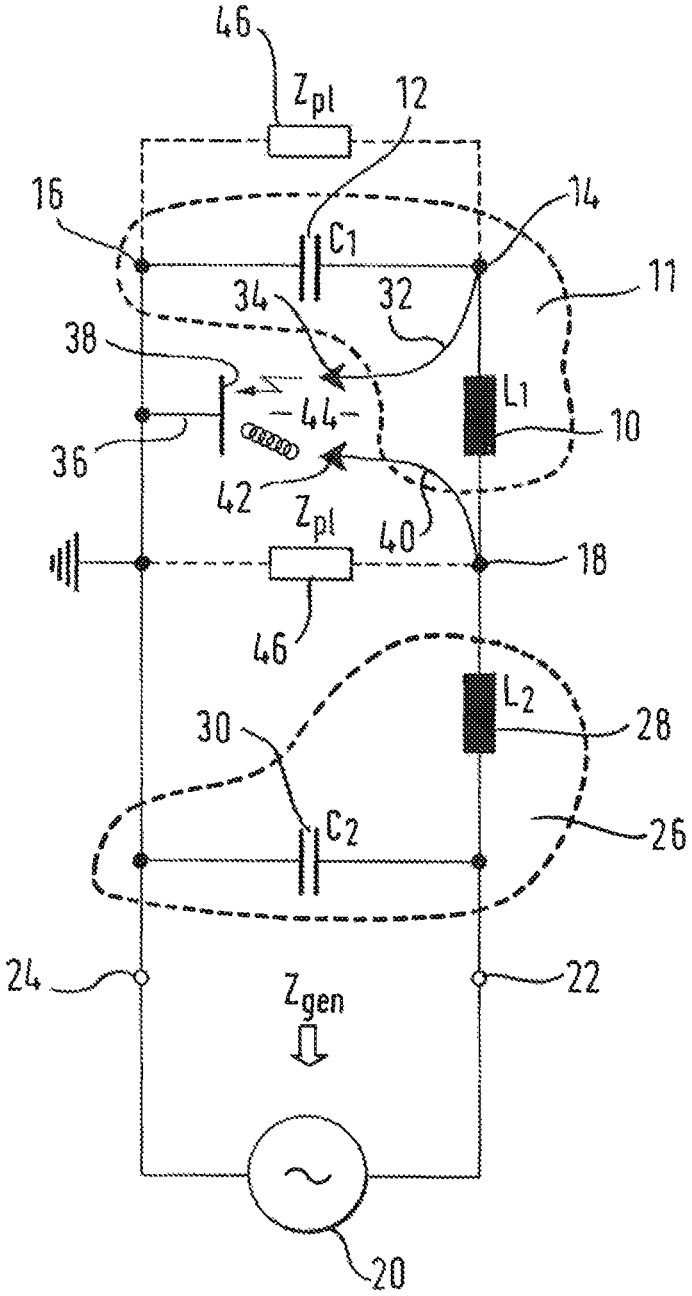
FIG. 1 is an electrical circuit diagram of the high-frequency plasma ignition device according to the invention.

In describing the preferred embodiment of the present invention, reference will be made herein to FIGS. 1-7 of the drawings in which like numerals refer to like features of the invention.

The present invention comprises a resonant series circuit which has an inductive portion or component(s) and a capacitive portion or component(s) connected in series, and a high-frequency generator having a first electrical terminal and a second electrical terminal for the resonant excitation of the resonant series circuit, a first electrical contact point being provided at which one end of the capacitive portion and one end of the inductive portion are connected together electrically, the capacitive portion having a second electrical contact point at an end which is remote from the first contact point and the inductive portion having a third electrical contact point at an end which is remote from the first contact point, an electrical connecting device being provided which connects the first terminal of the high-frequency generator to the third contact point electrically and the second terminal of the high-frequency generator to the second contact point electrically in such a way that an output signal from the high-frequency generator is applied to the resonant series circuit via the second and third electrical contact points, a first electrode being arranged and configured in such a way that it is connected electrically to the first electrical contact point and a second electrode being arranged and configured in such a way that it is connected electrically to the second electrical contact point, with the result that there is available between a free end of the first electrode, which free end is remote from the first electrical contact point, and a free end of the second electrode, which free end is remote from the second electrical contact point, a voltage for igniting a plasma between the free ends of the first and second electrodes, which voltage is applied across the capacitive portion (thus forming a plasma ignition circuit), as delineated herein and in the claims.

The underlying object of the invention is achieved by a high-frequency plasma ignition device of the above kind which has the features defined herein and delineated in the claims. Advantageous embodiments of the invention are further described herein and in the claims.

In a high-frequency plasma ignition device of the above kind, provision is made in accordance with the invention for a third electrode to be arranged and configured in such a way that it is electrically connected to the third electrical contact point, and a free end of the third electrode, which free end is remote from the third electrical contact point, is arranged in such a way that a voltage for maintaining the plasma after ignition is available between the free end of the third electrode and the free end of the second electrode, which voltage is applied via the second and third electrical contact points (thus forming a plasma maintaining circuit).

This has the advantage that, once the plasma has been ignited by the plasma ignition circuit, there automatically becomes available across the second and third electrodes a current to maintain the ignited plasma, which ignited plasma "almost short-circuits" or "shunts" the resonant series circuit via the path between the first and second electrodes, which is connected in parallel and is now of low resistance, while at the same time the resonant series circuit is automatically re-excited to a resonant state if the plasma between the electrodes is extinguished again and generates an ignition voltage between the first and second electrodes to immediately ignite the plasma again. In this way, an ignited plasma can be maintained between the electrodes for a predetermined length of time in a controlled way without the need for complicated and costly means for detecting an ignited plasma or for a means, controlled by the detecting circuitry, of changing over between a plasma ignition circuit and a plasma maintaining circuit.

Optimum and loss-free transmission of energy from the high-frequency generator into the resonant series circuit is achieved by giving the electrical connecting device an impedance matching network in such a way that an impedance between the first and second terminals of the high-frequency generator is on the one hand matched to an impedance between the second and third electrical contact points and on the other hand this is done in both states of operation (before and after the ignition of the plasma).

Particularly simple and at the same time exact impedance matching is achieved by giving the matching network an inductive portion or component(s), and in particular a coil, which connects the first terminal point of the high-frequency generator electrically to the third electrical contact point, and a capacitive portion or component(s), and in particular a capacitor, which connects the first terminal point of the high-frequency generator electrically to the second terminal point of the high-frequency generator.

A particularly simple mechanical structure, which can if required be incorporated in an insulated cable, is obtained by having the capacitive portion in the resonant series circuit formed by at least one capacitor, at least one parallel-plate capacitor, at least one spherical capacitor, at least one cylindrical capacitor, at least one co-axial cable, at least one pair of conductors, at least one feed-through capacitor, and/or by two electrical conductors of a predetermined length at a predetermined spacing with a dielectric between them.

A more simplified mechanical structure, which can if required be incorporated in an insulated cable, is obtained by having the inductive portion in the resonant series circuit formed by at least one coil, at least one toroidal coil, at least one cylindrical coil, at least one co-axial conductor, at least one coil having a magnetic core, at least one transformer, and/or at least one electrical conductor.

An even more simplified mechanical structure is obtained by giving the high-frequency plasma ignition device a housing which forms at least part of the second electrode.

The basic principle of the high-frequency plasma ignition device according to the invention and the basic way in which it operates are explained in detail below by reference to FIG. 1. FIG. 1 is an electrical equivalent circuit diagram of the high-frequency plasma ignition device according to the invention. The latter comprises a resonant series circuit 11 having an inductive portion or component(s) 10 (L1) and a capacitive portion or component(s) 12 (C1) which are connected together into a resonant series circuit by a first electrical contact point 14. This produces a second electrical contact point 16 at a free end of the capacitive portion 12 which is remote from the first electrical contact point 14 and a third electrical contact point 18 at a free end of the inductive portion 10 which is remote from the first electrical contact point 14. Also provided is a high-frequency generator 20 which generates a high-frequency signal as an output signal of predetermined frequency, amplitude and power between a first terminal 22 and a second terminal 24. This output signal corresponds in frequency to a resonant frequency of the resonant series circuit 11, which resonant frequency is obtained in a known way from the values of the inductance of the inductive means $L_1$ 10 and the capacitance of the capacitive means $C_1$ 12 by applying the formula $$f_{res} = \frac{1}{2\pi\sqrt{L_1 C_1}}$$

In this way, the high-frequency generator 20 is able to excite the resonant series circuit resonantly. The HF generator (20) has an impedance $Z_{gen}$.

The high-frequency generator 20 is connected to the resonant series circuit 11 via a connecting device 26, the first terminal 22 of the high-frequency generator 20 thus being connected electrically to the third electrical contact point 18 of the resonant series circuit and the second terminal 24 of the high-frequency generator 20 thus being connected electrically to the second electrical contact point 16 of the resonant series circuit. The electrical function performed by the connecting device 26 in this case is to match the output impedance $Z_{gen}$ of the high-frequency generator 20 across the two terminals 22, 24 to an impedance across the second and third electrical contacts 16, 18.

The term "impedance" or "output impedance" designates in the present case the a.c. resistance which specifies on the one hand the amplitude ratio of the sinusoidal a.c. voltage to the sinusoidal a.c. current and on the other hand the phase shift between these two variables.

If the output impedance of the high-frequency generator 20 is equal to the impedance across the second and third electrical contacts 16, 18, then the connecting device 26 merely has electrical conductors which on the one hand connect the first terminal point 22 to the third electrical contact point 18 electrically and on the other hand connect the second terminal point 24 to the second electrical contact point 16 electrically, in each case directly, without performing any impedance matching. It is however an advantage for high-frequency generators which already exist to be used. These have an output impedance of, for example, 50Ω. By contrast, there is typically an impedance of, for example, 12Ω across the second and third electrical contact points 16, 18. This being the case, provision is made for impedance matching by the connecting device 26. In the embodiment which is shown by way of example in FIG. 1, the connecting device 26 has a matching network having an inductive matching portion 28 ($L_2$) and a capacitive matching portion 30 ($C_2$). The inductive matching portion 28 is so arranged in this case that it connects the first terminal 22 and the third electrical contact point 18 together electrically, and the capacitive matching portion 30 is so arranged that it connects the third electrical contact point 18 and the second electrical contact point 16 together electrically. Electrically, this gives appropriate impedance matching of 50Ω to 12Ω, for which purpose the value of the capacitive matching portion $C_2$ 30 and the value of the inductive matching portion $L_2$ 28 are selected to suit the output frequency of the high-frequency generator 20 or in other words the resonant frequency of the resonant series circuit.

A first electrode 32 is connected to the first electrical contact point 14 electrically and a free end 34 of the first electrode 32 which is remote from the first electrical contact point 14 projects into a space or chamber 44 in which a plasma is to be ignited and is to be maintained for a predetermined length of time. A second electrode 36 is connected to the second electrical contact point 16 electrically and a free end 38 of the second electrode 36 which is remote from the second electrical contact point 16 projects into the space or chamber 44. A third electrode 40 is connected to the third electrical contact point 18 electrically and a free end 42 of the third electrode 40 which is remote from the third electrical contact point 18 projects into the space or chamber 44. The free ends 34, 38, and 42 of the electrodes 32, 36, and 40 are so arranged in the space or chamber 44 that given voltages arise between these ends 34, 38, and 42 when the plasma ignition device is operating and these cause corresponding electrical currents between the ends 34, 38, and 42, as will be explained in detail below.

Figure 7:
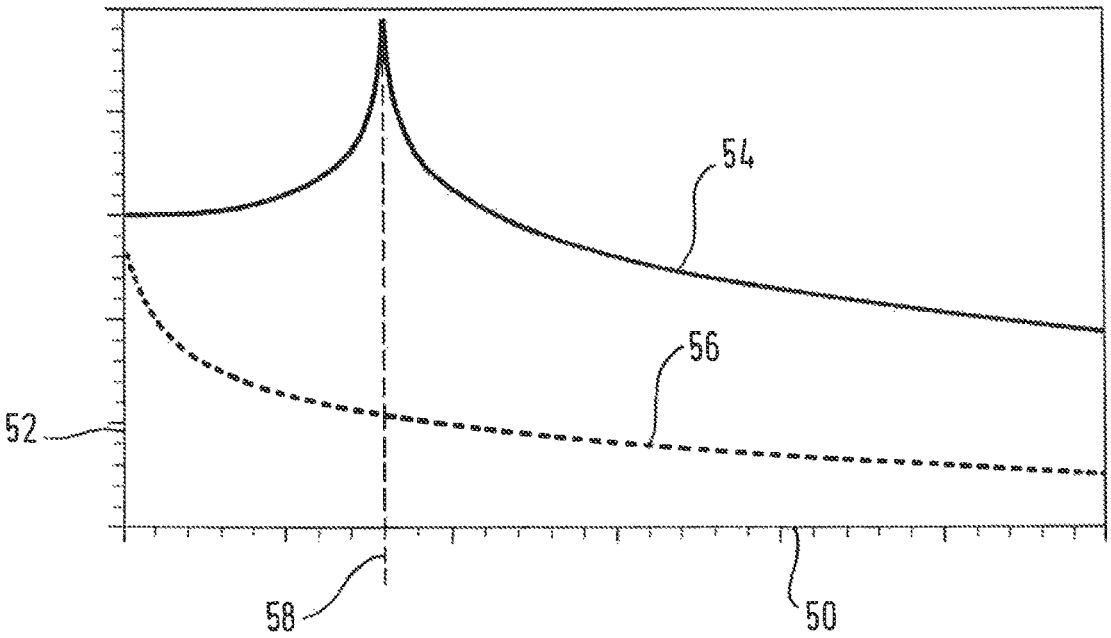
FIG. 7 is a graphic representation of a voltage drop across the capacitor of the resonant circuit as a function of the frequency at which the resonant circuit is excited by the generator.

FIG. 7 is a graphic representation of a voltage drop across the capacitor C1 12 of the resonant circuit 11 as a function of the frequency f at which the resonant circuit is excited by the generator 20. In FIG. 7, the frequency f at which the resonant circuit is excited by the generator 20 is plotted along a horizontal axis 50 and a drop of a voltage across the capacitor $C_1$ 12 is plotted along a vertical axis 52. A first curve 54 shows the variation in the voltage drop across the capacitor $C_1$ 12 as a function of the frequency f before a plasma is ignited in the space or chamber 44 and a second curve 56 shows the variation in the voltage drop across the capacitor $C_1$ 12 as a function of the frequency f after a plasma is ignited in the space or chamber 44. The resonant frequency $f_{res}$ of the resonant circuit 11 is situated on the line 58 and hence there is a high voltage drop before the ignition of the plasma (curve 54). After the ignition of the plasma, the low impedance of the plasma shunts the capacitor $C_1$ 12, as will be explained in detail below, and there is thus not an increased voltage drop (curve 56).

What initially exists for the electrical circuit is a state where there is no ignited plasma between the free ends 34, 38, and 42 of the electrodes 32, 36, and 40 in the space or chamber 44. The resonant excitation of the resonant series circuit 11 by means of the output signal from the high-frequency generator 20 results in a high value for a voltage which occurs at the two ends of the capacitive portion 12, i.e. across the first and second electrical contact points 14, 16 and hence at the free ends 34, 38 of the first and second electrodes 32, 36. In the resonant state (when $f=f_{res}$; see FIG. 7, curve 54), this voltage is high enough to ignite a plasma between the free ends 34, 38 of the first and second electrodes 32, 36. In other words, the voltage emitted by the high-frequency generator 20 is increased by a predetermined factor of, for example, 100 by the resonant excitation of the resonant series circuit 11. Before the ignition of the plasma in the space or chamber 44, the resonant series circuit 11 is only slightly damped. However, as soon as the plasma is ignited it results, as indicated in FIG. 1 by a dashed line, in electrical terms, in a resistance 46, of 12Ω for example, corresponding to the impedance $Z_{pl}$ of the plasma, being connected in parallel with the capacitive portion 12. This results in the voltage across the first and second electrical contacts 16, 18 collapsing, in the resonant series circuit 11 being shunted, and in the major proportion of the voltage at the inductive means 10 decaying. The voltage across the capacitive portion 12 drops (see FIG. 7, curve 56). Sufficient electrical current to maintain the plasma is thus no longer able to flow across a gap between the free ends 34, 38 of the first and second electrodes 32, 36. If other measures were not taken, the plasma between the free ends 34, 38 of the first and second electrodes 32, 36 in the space or chamber 44 would at once be extinguished again.

In accordance with the invention however, the third electrode 40 is provided. Immediately after the ignition of the plasma in the space or chamber 44 this becomes responsible for the flow of electrical current across a gap between the free ends 38, 42 of the second and third electrodes 36, 40 because this gap too is likewise shunted by the ignited plasma having a resistance $Z_{pl}$ of, for example, 12Ω. The free end 42 of the third electrode 40 is in fact so arranged that the ignited plasma extends at least partly into a gap between the free ends 38, 42 of the second and third electrodes 36, 40. Because the ignited plasma between the free ends 38, 42 of the second and third electrodes 36, 40 produces a bypass having a resistance $Z_{pl}$ 46 of approximately 12Ω, a resistance or rather impedance of 12Ω is apparent to the high-frequency generator 20 at the second and third contact points 16, 18 due to the third electrode even after the ignition of the plasma, and the high-frequency generator 20 continues to apply its full electrical energy or electrical power to the plasma. The only difference from the moment of ignition is that the electrical current no longer flows across the gap between the free ends 34, 38 of the first and second electrodes 32, 36 but across the gap between the free ends 38, 42 of the second and third electrodes 36, 40. For this purpose, the layout of the free ends 34, 38, 42 is so configured that the plasma which is ignited in the gap between the free ends 34, 38 of the first and second electrodes 32, 36 is also situated, locally, at least partly in the gap between the free ends 38, 42 of the second and third electrodes 36, 40.

Because the resonant series circuit 11 is so designed that the same impedance of, for example, 12Ω in the present case arises between the second and third electrical contacts 16, 18 before the plasma is ignited, then with regard to impedance matching there is no difference for the high-frequency generator 20 whether the plasma is ignited or not. In both cases, the high-frequency generator 20 is always able to feed in its full electrical power, with no return losses, on the one hand into the resonant series circuit 11 before and up to the time when the plasma ignites and on the other hand into the plasma between the free ends 38, 42 of the second and third electrodes 36, 40 after the ignition of the plasma.

Should the plasma be extinguished due to external factors, such for example as due to a high rate of flow of a medium, such for example as of an ignitable mixture into a combustion chamber of a working cylinder of an internal combustion engine acting as the space or chamber 44, then the bypass across the gap between the free ends 38, 42 of the second and third electrodes 36, 40 becomes of high resistance again and the damping of the resonant series circuit 11 by the parallel resistance $Z_{pl}$ 46 disappears, and the power from the high-frequency generator 20 is thus immediately fed into the resonant series circuit 11 again and the latter is therefore excited in a resonant state until the voltage for igniting the plasma is again reached across the capacitive means C1 12 and the plasma is ignited in the way explained above. It will therefore at once be apparent that the plasma ignition device according to the invention changes between the "ignite plasma" and "maintain plasma" modes of operation automatically and without any additional switching devices or plasma detectors, and thus, simply by feeding the output signal from the high-frequency generator 20 to the electrical contacts 16, 18, the plasma is ignited and maintained for as long as the output signal from the high-frequency generator 20 is applied in this way. Hence, in other words, the plasma can be generated and maintained for a defined or predetermined length of time simply by applying the output signal from the high-frequency generator 20 to the electrical contacts 16, 18 and disconnecting it therefrom.

The space or chamber 44 is for example a combustion chamber in a working cylinder of an internal combustion engine, the plasma thus serving to ignite a fuel/air mixture in an internal combustion engine. Because the plasma can be maintained for any desired length of time, more homogeneous combustion and highly reliable ignition is obtained for the fuel/air mixture. This is a particular advantage for internal combustion engines of the lean burn or stratified charge type because in these cases an ignitable mixture is present in the combustion chamber of the working cylinder only at a very specific place and a very specific point in time. The ignited plasma can be caused to make a very exact hit at this place and this point in time.

The invention has been explained in detail above by reference to a block or equivalent circuit diagram shown in FIG. 1 of the high-frequency plasma ignition device according to the invention. Illustrative embodiments of a high-frequency plasma ignition device according to the invention will be explained below.

Figure 2:
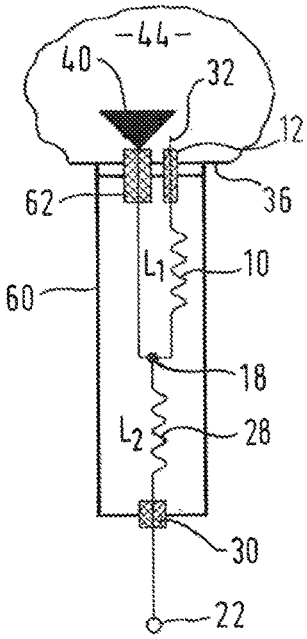
FIG. 2 is a schematic view of a first preferred embodiment of high-frequency plasma ignition device according to the invention.

FIG. 2 shows a first preferred embodiment of a high-frequency plasma ignition device according to the invention. Parts which perform the same functions as in FIG. 1 are given the same reference numerals as in FIG. 1 and reference should therefore be made to the above description of FIG. 1 for an explanation of them. The high-frequency plasma ignition device shown in FIG. 2 has a housing 60 which is formed from an electrically conductive material and which thus forms that part of the device shown in FIG. 1 which is connected to the terminal 24 of the high-frequency generator 20 electrically. The connecting device 26 is in the form of a matching network which comprises a capacitive portion $C_2$ 30 which takes the form of a feed-through capacitor, and an inductive portion $L_2$ 28 which is arranged inside the housing 60 and which takes the form of a simple coil. The feed-through capacitor 30 provides electrical insulation from the housing 60.

Figure 3:
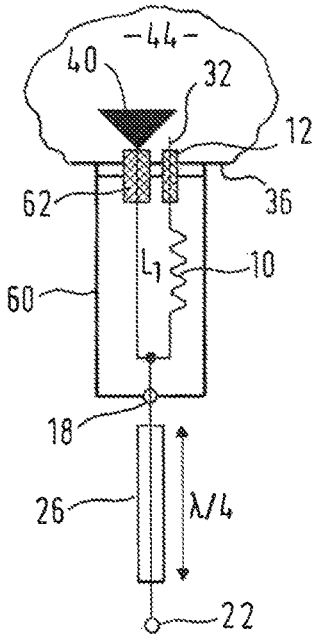
FIG. 3 is a schematic view of a second preferred embodiment of high-frequency plasma ignition device according to the invention.

FIG. 3 shows a second preferred embodiment of a high-frequency plasma ignition device according to the invention. Parts which perform the same functions as in FIGS. 1 and 2 are given the same reference numerals as in FIGS. 1 and 2 and reference should therefore be made to the above descriptions of FIGS. 1 and 2 for an explanation of them. The construction of the high-frequency plasma ignition device is substantially the same as that of the first preferred embodiment shown in FIG. 2. In the second preferred embodiment shown in FIG. 3, the matching network 26 takes the form of a λ/4 line and the inductive portion $L_1$ 10 that of a simple coil.

Figure 4:
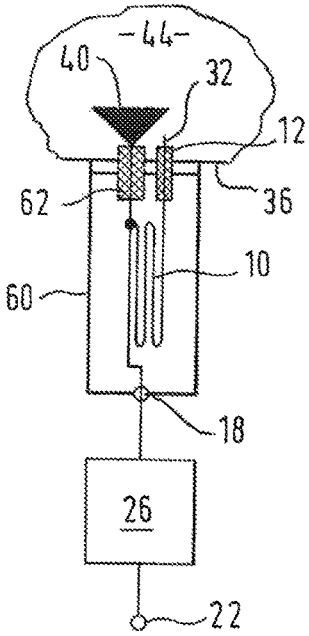
FIG. 4 is a schematic view of a third preferred embodiment of high-frequency plasma ignition device according to the invention.

FIG. 4 shows a third preferred embodiment of a high-frequency plasma ignition device according to the invention. Parts which perform the same functions as in FIGS. 1 to 3 are given the same reference numerals as in FIGS. 1 to 3 and reference should therefore be made to the above descriptions of FIGS. 1 to 3 for an explanation of them. The third electrode 40 passes through the housing 60 by an electrical insulator 62. The first electrode 32 passes through the housing by a feed-through capacitor 12 which on the one hand provides electrical insulation between the first electrode 32 and the housing 60 and on the other hand forms the capacitive portion $C_1$ 12. The inductive portion $L_1$ 10 takes the form of a phasing line.

Figure 5:
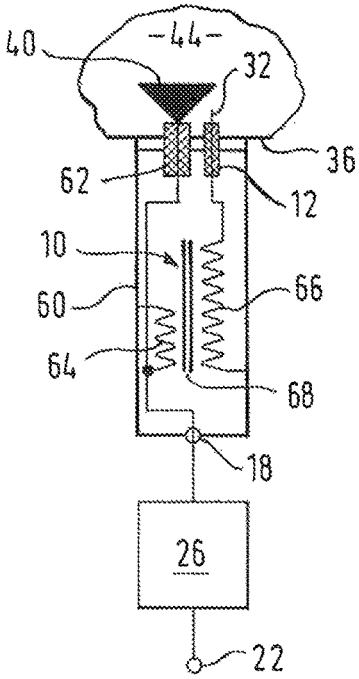
FIG. 5 is a schematic view of a fourth preferred embodiment of high-frequency plasma ignition device according to the invention.

FIG. 5 shows a fourth preferred embodiment of a high-frequency plasma ignition device according to the invention. Parts which perform the same functions as in FIGS. 1 to 4 are given the same reference numerals as in FIGS. 1 to 4 and reference should therefore be made to the above descriptions of FIGS. 1 to 4 for an explanation of them. The construction of the high-frequency plasma ignition device is substantially the same as that of the first preferred embodiment shown in FIG. 2. The inductive portion $L_1$ 10 takes the form of a transformer having a primary winding 64, a secondary winding 66 and a core 68 made of a magnetic material. This transformer causes in addition an increase in the voltage across the capacitive portion $C_1$ 12, which the transformer does by stepping up the voltage in line with the ratio of the primary winding 64 and secondary winding 66 to one another.

Figure 6:
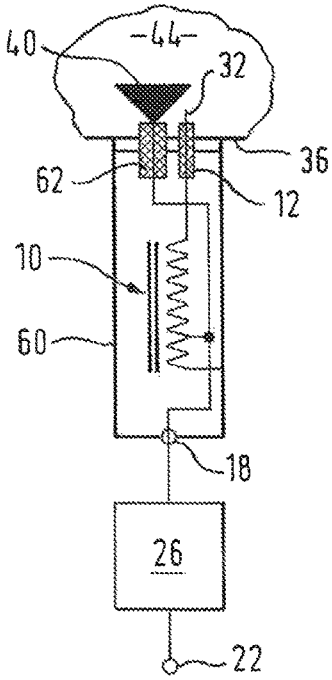
FIG. 6 is a schematic view of a fifth preferred embodiment of high-frequency plasma ignition device according to the invention.

FIG. 6 shows a fifth preferred embodiment of a high-frequency plasma ignition device according to the invention. Parts which perform the same functions as in FIGS. 1 to 5 are given the same reference numerals as in FIGS. 1 to 5 and reference should therefore be made to the above descriptions of FIGS. 1 to 5 for an explanation of them. The construction of the high-frequency plasma ignition device is substantially the same as that of the fourth preferred embodiment shown in FIG. 5. The inductive portion $L_1$ 10 takes the form of an inductor having a magnetic core and in particular that of a toroidal-cored coil having a toroidal core made of a magnetic material, around which an electrical conductor is wound. The special feature of this construction is that, as in FIG. 5, what is provided as the inductive portion $L_1$ 10 is a transformer, this latter taking the form of a so-called "auto-transformer", i.e. one with no electrical isolation between the primary and secondary circuits.

All in all, the high-frequency plasma ignition device according to the invention provides a capacity for automatic re-ignition if the plasma is unintentionally extinguished after its ignition and before its maintaining comes to a desired end. Because of the internal inductive portion(s) ($L_1$ 10 and/or $L_2$ 28), blowing outward of the plasma may possibly occur due to the alternating magnetic fields produced, as a result of which quicker and better distribution into the space or chamber 44 is obtained of the plasma coming from the electrode 40. This is a particular advantage in the case of the ignition of mixtures in a combustion chamber of a working cylinder of an internal combustion engine.

The values of the inductance of the inductive portion $L_2$ 28 of the matching network 26 and of the capacitance of the capacitive portion $C_2$ 30 thereof are preferably determined from the formula $$\frac{L_2}{C_2} = Z_{pl} Z_{gen}.$$

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A high frequency plasma ignition device for the ignition of a fuel/air mixture in a combustion chamber of an internal combustion engine, comprising:

a resonant series circuit having an inductive portion and a capacitive portion connected in series;

a high-frequency generator having a first electrical terminal and a second electrical terminal for the resonant excitation of the resonant series circuit;

a first electrical contact point being provided at which one end of the capacitive portion and one end of the inductive portion are connected together electrically;

the capacitive portion having a second electrical contact point at an end which is remote from the first contact point and the inductive portion having a third electrical contact point at an end which is remote from the first contact point;

an electrical connecting device being provided which connects the first terminal of the high-frequency generator to the third contact point electrically and the second terminal of the high-frequency generator to the second contact point electrically such that an output signal from the high-frequency generator is applied to the resonant series circuit via the second and third electrical contact points, a first electrode being connected electrically to the first electrical contact point and a second electrode being connected electrically to the second electrical contact point, such that there is available between a free end of the first electrode, which free end is remote from the first electrical contact point, and a free end of the second electrode, which free end is remote from the second electrical contact point, a voltage for igniting a plasma between said free ends of the first and second electrodes, which voltage is applied across the capacitive portion; and a third electrode electrically connected to the third electrical contact point, and a free end of the third electrode, which free end is remote from the third electrical contact point, is arranged such that a voltage for maintaining the plasma after ignition is available between said free end of the third electrode and the free end of the second electrode, which voltage is applied via the second and third electrical contact points.

2. The high frequency plasma ignition device of claim 1, wherein the electrical connecting device comprises an impedance matching network, such that an impedance between the first and second terminals of the high-frequency generator is matched to an impedance between the second and third electrical contact points.

3. The high frequency plasma ignition device of claim 2, wherein the matching network includes an inductive portion including a coil, which connects the first terminal point of the high-frequency generator electrically to the third electrical contact point, and a capacitive portion including a capacitor, which connects the first terminal point of the high-frequency generator electrically to the second terminal point of the high-frequency generator.

4. The high frequency plasma ignition device of claim 1, wherein the capacitive portion in the resonant series circuit includes at least one capacitor, at least one parallel-plate capacitor, at least one spherical capacitor, at least one cylindrical capacitor, at least one co-axial cable, at least one pair of conductors, at least one feed-through capacitor, or by two electrical conductors of a predetermined length at a predetermined spacing with a dielectric between them, or any combination thereof.

5. The high frequency plasma ignition device of claim 1, wherein the inductive portion in the resonant series circuit includes at least one coil, at least one toroidal coil, at least one cylindrical coil, at least one co-axial conductor, at least one coil having a magnetic core, at least one transformer, or at least one electrical conductor, or any combination thereof.

6. The high frequency plasma ignition device of claim 1, wherein the high-frequency plasma ignition device includes a housing which forms at least part of the second electrode.

7. The high frequency plasma ignition device of claim 3, wherein the capacitive portion in the resonant series circuit includes at least one capacitor, at least one parallel-plate capacitor, at least one spherical capacitor, at least one cylindrical capacitor, at least one co-axial cable, at least one pair of conductors, at least one feed-through capacitor, or by two electrical conductors of a predetermined length at a predetermined spacing with a dielectric between them, or any combination thereof.

8. The high frequency plasma ignition device of claim 3, wherein the inductive portion in the resonant series circuit includes at least one coil, at least one toroidal coil, at least one cylindrical coil, at least one co-axial conductor, at least one coil having a magnetic core, at least one transformer, or at least one electrical conductor, or any combination thereof.

9. The high frequency plasma ignition device of claim 3, wherein the high-frequency plasma ignition device includes a housing which forms at least part of the second electrode.

10. The high frequency plasma ignition device of claim 7, wherein the high-frequency plasma ignition device includes a housing which forms at least part of the second electrode.

11. The high frequency plasma ignition device of claim 8, wherein the high-frequency plasma ignition device includes a housing which forms at least part of the second electrode.

* * * * *